United States Patent [19]

Sanderson

[11] Patent Number: 4,768,412

[45] Date of Patent: Sep. 6, 1988

[54] LOW PROFILE KEYBOARD DEVICE AND SYSTEM FOR RECORDING AND SCORING MUSIC

[76] Inventor: Stephen N. Sanderson, 6301 Glendora Dr. N.E., Albuquerque, N. Mex. 87109

[21] Appl. No.: 861,317

[22] Filed: May 9, 1986

[51] Int. Cl.[4] ..... G10G 7/00; G10H 1/18

[52] U.S. Cl. ..... 84/1.1; 84/1.24; 84/453; 84/DIG. 7

[58] Field of Search ..... 84/461, 462, 463, 470 R, 84/477 R, 478, 1.01, 1.03, 1.06, 1.24, 1.1, 453, DIG. 7

[56] References Cited

U.S. PATENT DOCUMENTS

| | | | |
|---|---|---|---|
| 1,194,302 | 8/1916 | Liefield . | |
| 2,505,608 | 7/1946 | Edwards | 84/470 |
| 3,789,719 | 2/1974 | Maillet | 84/115 |
| 3,890,871 | 6/1975 | Oberheim | 84/1.01 |
| 3,905,267 | 9/1975 | Vincent | 84/115 |
| 4,023,456 | 5/1977 | Groeschel | 84/115 |
| 4,132,142 | 1/1979 | Campbell | 84/115 |
| 4,160,399 | 7/1979 | Deutsch | 84/1.03 |
| 4,215,619 | 8/1980 | Budelman et al. | 84/1.28 |
| 4,244,259 | 1/1981 | Koike | 84/1.19 |
| 4,351,221 | 9/1982 | Starnes et al. | 84/1.28 |
| 4,362,934 | 12/1982 | McLey | 84/DIG. 7 |
| 4,448,103 | 5/1984 | Blakely et al. | 84/1.01 |
| 4,487,101 | 12/1984 | Ellen | 84/462 |

*Primary Examiner*—S. J. Witkowski

*Attorney, Agent, or Firm*—Deborah A. Peacock; Robert W. Weig

[57] ABSTRACT

A portable modular music recording device which simply and unobtrusively attaches to a keyboard instrument for purposes of recording live musical performances; and an efficient music microcomputing system in which the captured musical data is digitized and further analyzed to determine note and note expression information when a key has been played. In the modular keyboard device, key and key expression data is captured by means of photosensitive couplers mounted in the keyboard device, and the information is transmitted to the processing unit. Microcomputer instructions refine the data to a format suitable for serial transmission via a computer-compatible link for ultimate scoring and recording.

15 Claims, 8 Drawing Sheets

KEY DOWN

KEY UP

LOW PROFILE KEYBOARD DEVICE AND SYSTEM FOR RECORDING AND SCORING MUSIC

BACKGROUND OF THE INVENTION

This invention relates to a convenient, low cost modular device to be unobtrusively attached to any keyboard instrument which electronically captures musical note and note expression data; and a processing system to convert and transmit the data to computer-compatible interfaces thereby recording live musical performances.

Various inventions have been devised to assist musicians in performing, arranging, recording and composing music. An historically early method of recording music which is still in use today is the player piano. Holes, corresponding to particular notes, are punched in paper which is rotated as the player piano is played. Recording music with this technique requires an entirely different instrument than the piano or substantial adjustments to a conventional piano. U.S. Pat. No. 1,194,302, entitled "MUSIC RECORDER," to Liefield, discloses an extremely bulky electrical attachment which is capable of recording musical notes on a rotating sheet of paper to be applied to a conventional keyboard instrument. The device of this invention which attaches to the keyboard, however, covers more than half of the keyboard and thus interferes with a musician's efforts at the keyboard. U.S. Pat. No. 4,351,221, entitled, "PLAYER PIANO RECORDING SYSTEM," to Starnes et al, teaches a more modern recording system in which player piano tapes are prepared. This system requires the elaborate and delicate installation of photosensors to the underside of the piano keys. While the invention does not interfere with the musician's use of the keyboard, such installation of the apparatus to the keyboard is expensive and requires the services of a skilled piano tuner or electronics technician. This invention is furthermore limited in its application because the purpose of the invention is to create player piano tapes and not a musical score for immediate viewing by the musician. Another example of a musical recording system is given in U.S. Pat. No. 3,798,719, entitled "TAPE ACTIVATED PIANO AND ORGAN PLAYER," to Maillet, which again requires the elaborate installation of sensitive electronics to the underside of a keyboard, with the accompanying disadvantages of being costly and requiring skilled persons to render the invention useful. U.S. Pat. No. 3,905,267, entitled "ELECTRONIC PLAYER PIANO WITH RECORD AND PLAYBACK FEATURE," to Vincent, teaches an electronic data storage system including a magnetic type recorder/replayer for recording spontaneous musical presentations for replay through a similar instrument. To capture the musical data, the invention also requires extensive and expensive modifications to the underside of each key in the instrument. See also U.S. Pat. No. 4,023,456, entitled "MUSIC ENCODING AND DECODING APPARATUS," to Groeschel, for yet another example of how electronic switching to monitor keyboard action requires bulky circuitry and modification of the keyboard from within the instrument.

The sequencer is a viable alternative method of recording music which has been developed in the prior art, although early in its development, the sequencer was a massive network of electronics, often covering walls in a recording studio. Musicians are able to record and immediately play back music with the use of sequencers. A sequencer, in its simplest form, consists of a series of adjustable voltage memories stepped by a clock pulse. The typical analog sequencer uses potentiometers and variable resistors, each including a manually operable dial for establishing a certain DC voltage. In order to load the sequencer, the musician manually sets each potentiometer. Thereafter, the bank of potentiometers is scanned sequentially and the DC voltages are read to a voltage controlled oscillator (VCO) which then produces the melody or the rhythm. The sequencer thus enables the musician to repeatedly listen to the melody and make changes by varying the potentiometer dials. Sequencers are used to create the familiar insistent machine-beat that has been used in electronic organs. See Keyboard Synthesizer Library, Vol. 3, *Synthesizers and Computers,* p. 37 (1985). While the sequencer produces the accompaniment, a musician can play the lead line of the same or another keyboard, or even another instrument.

With the advent of solid state electronics, smaller and more efficient electronics have been combined in the prior art to produce a digital sequencer. Typical digital sequencers utilize a Read/Write memory storing a plurality of words, each word being coded to represent a note played on the keyboard. Once the memory has been coded, the sequencer can be used to play the keyboard instrument by reading back the data words in the memory in time sequence. See U.S. Pat. No. 3,890,871, entitled, "APPARATUS FOR STORING SEQUENCES OF MUSICAL TONES," to Oberheim; U.S. Pat. No. 4,160,399, entitled, "AUTOMATIC SEQUENCE GENERATOR FOR A POLYPHONIC TONE SYNTHESIZER," to Deutsch; and U.S. Pat. No. 4,487,101, entitled "DIGITAL SOLID STATE RECORDING OF THE SIGNALS CHARACTERIZING THE PLAYING OF A MUSICAL INSTRUMENT," to Ellen. While providing an improved and efficient means of recording music, sequencers do not provide a written means of preservting music on musical score sheets. More importantly, however, sequencers require an electronic musical instrument and have not been adapted to conventional acoustic keyboard instruments, such as the piano.

The electronic music revolution has led to the invention of the synthesizer, an electronic musical instrument. Sequencers, as described above, have been incorporated into the synthesizer, so that while the musician plays music on a synthesizer keyboard, sequencers within the synthesizer plays back various accompaniments that the musician loaded previously into the sequencer. The use of sequencers allows the musician to compose and record various tracks of music. The electronic instruments generate musical data consisting of a series of binary digits, called bits. A number of digits representing a complete musical expression, such as which note has been played and the particular style, is called a data word. The words are then stored in a memory unit which can store only a finite number of these binary data words. The length of the recorded music, therefore, is limited by the amount of memory in the solid state chips used in digital sequencers. Microprocessor technology provides the means for storing lengthy sequences by transferring the digitized musical data stored in memory to peripheral devices such as computer diskettes. Examples of electronic musical instruments which incorporate microprocessor technology include the Ensoniq Mirage TM, various Korg polyphonic synthesizers, and the Casio CZ 101 TM.

The computer, especially the personal home computer, further revolutionized the electronic music industry with the creation of software capable of interpreting the notes played on the keyboard and printing the music in musical scored form. The music industry desired a communication standard to be used among the multitude of electronic music manufacturers and the multitude of available home computers. The standard decided upon was MIDI, an acronym for Musical Instrument Digital Interface. In its simplest application, MIDI permits a musician to play two or more instruments from a single keyboard, in order to layer musical tone colors. In its most comprehensive application, MIDI provides the means for realizing a multi-track recorder or a computer-based composing system by connecting several instruments to a master controller or computer. Computer software is available, furthermore, which can transform the music from digital format to a conventional musical score, both on the computer screen and as printed out on paper in hard copy. Commercially available software which can convert MIDI data to scored music or to a format to be viewed on a computer terminal for editing purposes include the MIDI Performance Series TM by Passport, and the MPS TM written by Kentyn Reynolds for IBM-compatible personal computers.

The current limitation to the MIDI computer-musical interface is that it requires expensive and complex electronic musical instruments such as synthesizers or sequencers. MIDI was not designed to be adapted for the conventional non-electronic musical instrument, such as the piano. MIDI Retrofit Kits TM are currently available from Forte Music Company to accommodate acoustic pianos; however, these retrofit kits require extensive modification on the underside of the piano keys as has been described on some of the previous efforts to record keyboard music.

Accordingly, it is a primary object of the present invention to provide an inexpensive, lightweight and unobtrusive device for the purpose of scoring and recording live music performances.

It is another object of the present invention to provide an electronic device which is both noninvasive, portable and convenient to attach to any keyboard instrument, and which does not require piano tuning or electronics expertise for proper installation of the keyboard sensing electronics to record and score music.

Still another object of the present invention is to provide modular keyboard devices which easily interconnect to span any size or length of any keyboard instrument for purposes of recording and scoring music.

Another object of the invention is to provide a modular keyboard device with simplified electronics and a minimal number of wires for sequential capture of key and key expression data.

Another object of the invention is provide a photosensitive method to detect which key is played and the velocity with which a particular key is struck, thus allowing for further musical expressions, such as staccato, legato, pianissimo, or fortissimo to be recorded simultaneously with the performance.

A further object of the present invention is to convert analog musical information into digital data compatible with a MIDI interface for ultimate recording and scoring with the use of a personal computer and appropriate software.

Other objects and further scope of applicability of the present invention will become apparent from the detailed description to follow, taken in conjunction with the accompanying drawing.

SUMMARY OF THE INVENTION

This invention relates to a device and a system used to capture, convert and transmit musical data obtained from a keyboard instrument during live performances to a computer-compatible link and then to a computer which enables the performance to be viewed on a computer screen or to be printed out in music-scored form. Musical information, comprising both key and key expression, is sequentially captured using optical transmissive couplers within the modular music recording device of the invention. The information is preferably serially transmitted to and analyzed in a microcomputer unit which converts analog data to binary logic, calculates the attack and release velocity with which a key is struck, and further converts the data to a computer-compatible format.

The device of the invention, the keyboard module, is superior in terms of cost, convenience, portability and efficiency to prior art keyboard music recording devices. The module is lightweight, compact and minimally interferes with the musician's movements as he plays a keyboard instrument. The modular device of the invention, furthermore, is applied to, rather than installed in the keyboard instrument; the modules simply rest on top of the keys. Preferably, the modules are in octave units to further provide increased flexibility to the musician; the musician may use as few or as many octave modules to record music played on only one or several octaves, to record music on a smaller keyboard instrument, or to record music which spans all octaves of, for example, a standard acoustic piano. The modules simply interconnect, thereby increasing the length of the keyboard strip comprising the device of the invention. The modules, moreover, are portable and can be easily removed and attached to a different keyboard instrument.

Musical data comprising key and key expression information is captured within the modular device of the invention with the use of optical transmissive couplers There is one optical transmissive coupler corresponding to each key covered by the module; therefore, in a one octave module, there are twelve optical transmissive couplers because there are twelve keys (including black and white keys) in a typical keyboard octave. The optical transmissive couplers are mounted within the keyboard mold of the module. When a key is at rest or in an "up" position, light emanating from a light emitting diode (LED) of the optical transmissive coupler impinges on a phototransistor. The phototransistor responds to the amount and intensity of the light by generating a proportional analog voltage. When, however, a key is struck or played and in a "down" position, a wiper assembly, also connected to the keyboard mold, and an attached piston correspondingly move downward and block light impinging on the phototransistor, resulting in a decreased analog voltage signal. Thus, key information is captured by the optical transmissive couplers. Preferably each piston and wiper assembly pair are connected by adjustable connecting means to accomodate various key heights on different keyboards. Furthermore, key stroke velocity information is contained in the duration and strength of the analog voltage signal. This information is extracted by counting clock pulses starting at a time when the signal achieves a calibrated voltage level generated by the phototransistors, and ending at a time when the signal achieves a different set voltage level. The sequential strobing of the LEDs results in minimal power requirements and a minimal number of data lines in and out of the device of the invention because only one optical transmissive coupler is enabled at a time.

Analog voltage data from the device of the invention is analyzed preferably in a processing unit. The processing unit preferably comprises a comparator circuit which compares the incoming analog voltage with previously calibrated high and low voltage levels for purposes of determining key stroke velocity. During this comparison process, the voltage data is digitized. The processing unit further preferably comprises a compensation circuit which functions to increase the response time of the device and the system of the invention.

The processing unit also further comprises clocking means derived from the processor's oscillating crystal. Clock pulses are transmitted to the modular keyboard device of the invention, thereby sequentially enabling one optical transmissive coupler with each clock pulse. Algorithm instructions are also executed at the clock rate within the microcomputer. The clocking means then preferably provides the rate at which each LED is strobed, a means to detect key stroke velocity, and a rate for processing note and note expression data.

The processing unit further comprises a microcomputer. The microcomputer initializes the system of the invention and prepares the computer-compatible link for data acquisition, analysis, and transmission. The microcomputer then enables clock pulses to be transmitted to the keyboard modular device. Optical transmissive couplers are "turned on" at the clock rate, one at a time. The resultant analog voltage signal generated by the phototransistors of the optical transmissive couplers is sent to the comparator circuit. Output data from two comparators enters the microcomputer and is compared. If the two outputs of the comparator circuit are not equal, a counter or timing register is loaded and incremented to calculate key stroke velocity. If the outputs of the comparator circuit are equal, i.e., both logical zero or both logical one, then the microcomputer stops the counter and interrogates the previous state of the key. If no change has occurred in the state of the key between cycles of interrogation, then the next key of the keyboard is strobed. If a state change has occurred, then the timing register count is converted to note velocity information. Thus, the system of the invention operates efficiently because it monitors and transmits only changes of state of the keys, rather than monitoring the state of every key at every strobe. Data conversion algorithms are burned into a PROM/ROM (Programmable Read Only Memory/Read Only Memory) chip contained in the microcomputer of the processing unit. As previously mentioned, program instructions contained in the PROM/ROM are executed in the microcomputer at clock rates; therefore, data from one key is acquired, analyzed, and transmitted before the next key on the keyboard is strobed. Additional data algorithms convert note and note expression data into a format that can be transferred via a computer-compatible link, preferably the MIDI, by cross-referencing to a PROM/ROM table. Thereafter, commercially available computer software, common to the art, performs further editing and screening functions of the live musical performance.

BRIEF DESCRIPTION OF THE DRAWINGS

FIGS. 3(*a*) and 3(*b*) are perspective views of the principle of operation of the device of the invention detecting that a key has been played and detecting the velocity with which the key was struck, with FIG. 3(*a*) illustrating the principle of operation when the key is in a down or played position and FIG. 3(*b*) illustrating the principle of operation when the key is in an up or at rest position.

DESCRIPTION OF THE PREFERRED EMBODIMENT

Figure 1:
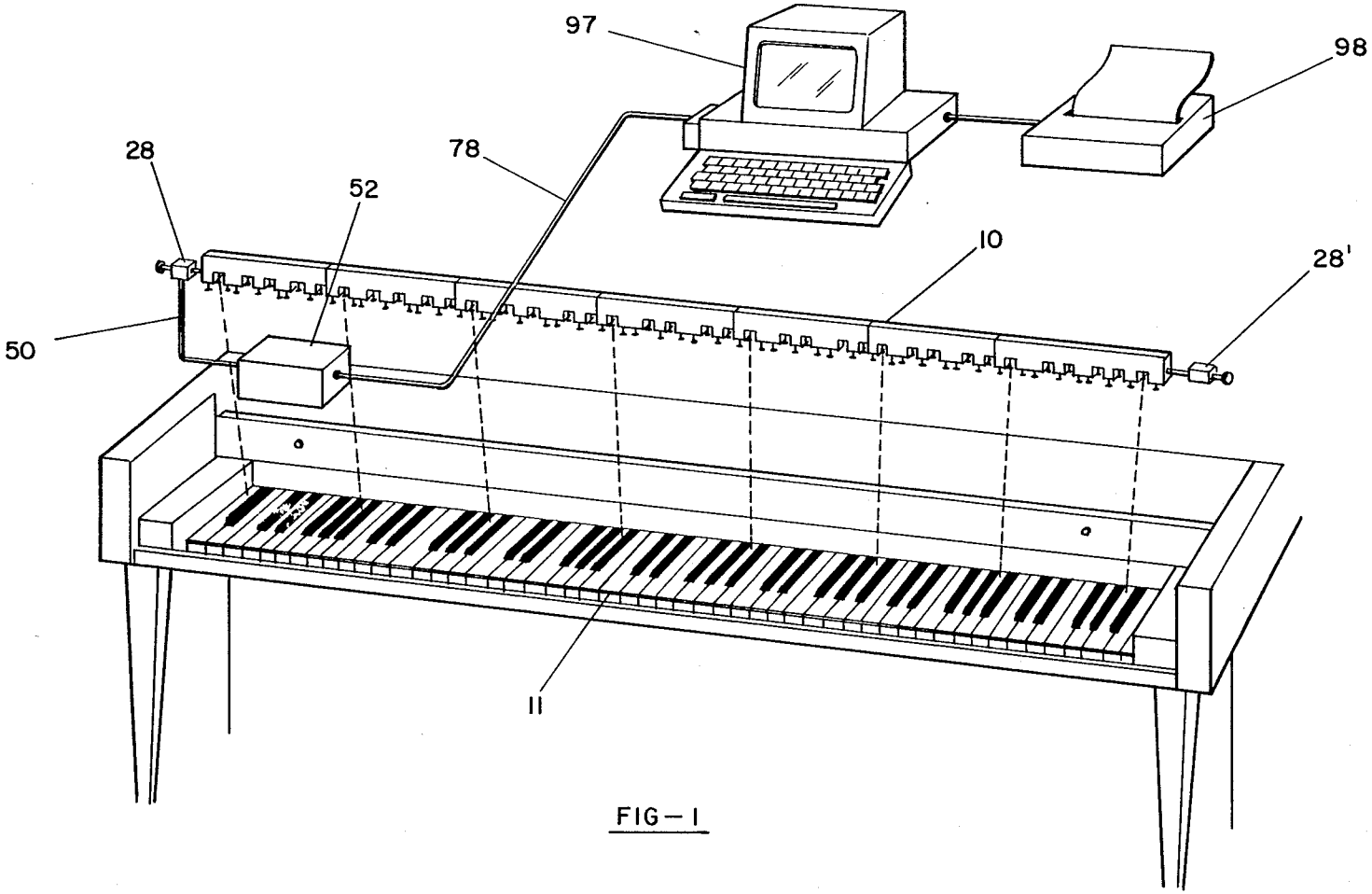
FIG. 1 is a perspective view of seven interconnected low profile keyboard modular devices of the invention, their relation to a conventional keyboard, their relation to a processor unit, and their interface with a MIDI link and a personal computer.

This invention relates to a modular device used to acquire and record musical information comprising note and note expression data to be used in conjunction with a keyboard instrument. The invention further relates to a microprocessor-based data analysis and conversion system which processes, converts, and transmits the note and note expression data in a format suitable for computer communications. A computer-compatible link, such as a MIDI unit, enables the musician to record, edit, or print the music in various forms, including scored music.

Throughout the description of the invention, the terms "note" and "key" may be used interchangeably. The terms "key" and "key expression," however, more specifically refer to the physical key on the keyboard and the manner in which the key was played by the musician. The terms "note" and "note expression," on the other hand, more specifically refer to the interpretation of the key and key expression data. It is the note and note expression data which is printed out or viewed at a computer terminal.

The modular device of the invention, used to acquire unimpeded musical performance information, comprises a thin strip electronic package (see FIG. 1) having modules 10 which link together to span any number of keys or octaves up to the full length of a keyboard 11.

The keyboard strip is placed at the back of the keys and covers a minimal area of the key. The modules 10 are easily interconnected and held in place on the keyboard 11. Interconnecting circuitry contained in the modules 10 is attached to a processor cable 50 which, in turn, is connected to a processor unit 52. The processor unit 52 analyzes and converts the raw data into a format that is readily acceptable to a computercompatible link 78 such as a MIDI interface. The processor unit 52 is coupled to a computer 97 through the computer-compatible link 78. Use of music processing software, common to the art, then allows the music data to be manipulated by a computer 97 and the music score to be viewed on a computer screen or CRT or printed out on a printer 98.

Figure 2:
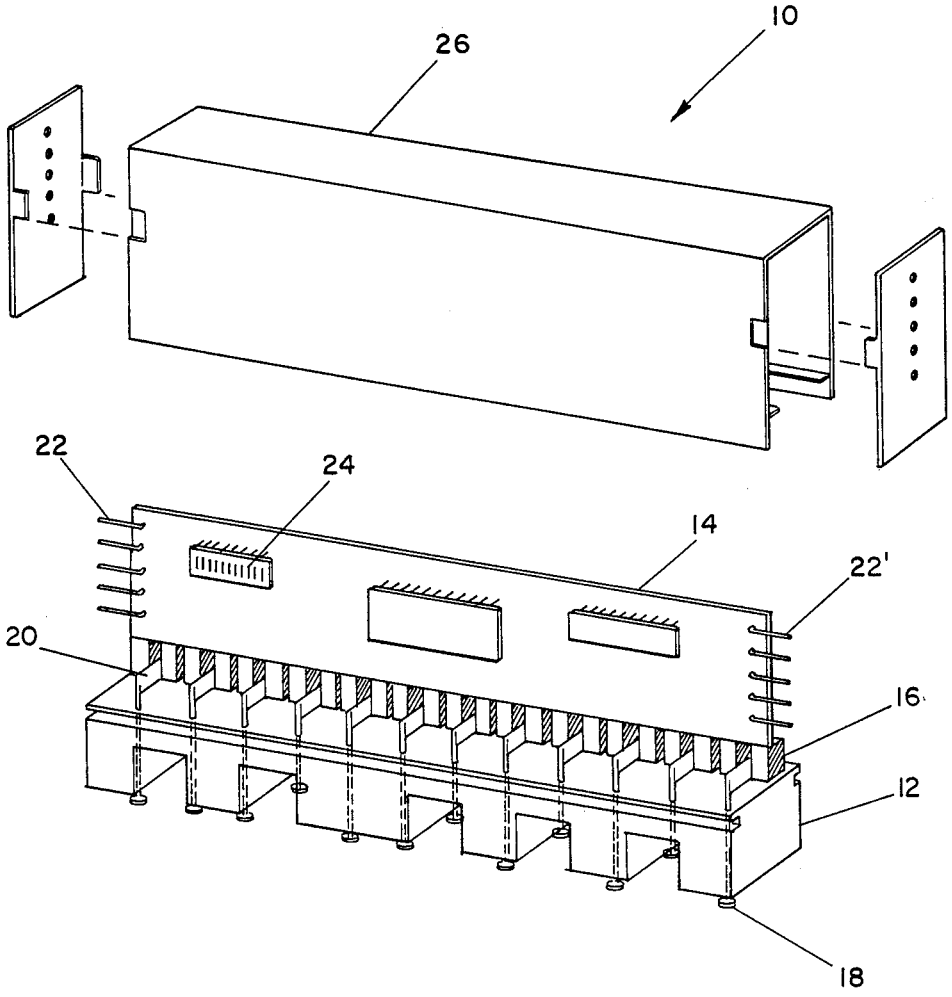

The modular device of the invention 10, as shown in FIGS. 1 and 2, preferably comprises a lightweight comb-shaped keyboard mold 12; an on-board circuit 14; optical transmissive couplers 16, pistons 18, and connected wiper assemblies 20, one for each key covered by the module; connecting means 22 and 22'; a dip switch 24; a module cover 26 which covers the on-board circuit 14, the optical transmissive couplers 16, and the wiper assemblies 20; and bracing means 28 and 28' for attaching and stabilizing the modular device to a keyboard. The modular device may span any number of keys or octaves, or an entire keyboard. Preferably, the module is an octave module, comprising twelve optical transmissive couplers, twelve pistons, and twelve connected wiper assemblies, corresponding to the twelve keys in an octave.

The modular keyboard device is lightweight, weighing between approximately five ounces and twelve ounces for an octave module, and preferably less than eight ounces. The modular device, when seated on the rear of the keys, preferably covers less than one inch, and most preferably less than one-half inch of the length of the keys. Because of this important feature, the device does not interfere with the musician's hand motions as he plays the keyboard instrument. This concept is in stark contrast to prior art mechanisms mounted on keyboard instruments which cover a large portion of the keys, thereby inhibiting the musician's manual dexterity. The device of the invention is, moreover, audibly unobtrusive by preferably dampening mechanical clicking with the installation of dampening means, such as felt pads, between associated parts.

A further advantage of the device of the invention is the convenient and noninvasive method of attaching the modular device of the invention 10 to the keyboard instrument. The modules 10 are simply placed on top of the keyboard 11; the comb-shaped keyboard mold 12 thereby fitting the spaces among the white and black keys (see dashed lines in FIG. 1). The modules 10 are easily connected by connecting means, such as pin-to-socket fittings 22 and 22' (see FIG. 2), and are held in place on the keyboard by bracing means, such as adjustable end braces 28 (see FIG. 1). Thus, the attachment of the modular device of the invention does not require the expert installation and adjustment of sensitive electronics to the underside of the keys from within the instrument, as with prior art music recording devices.

Another advantage of the device of the invention, over prior art methods of detecting keyboard motion, is that the use of modules permits a great deal of portability and flexibility not found in the prior art. The modules are detachable from the keyboard and can be easily attached to any keyboard instrument. This portable feature of the device of the invention is not disclosed in prior art devices. The portable feature further allows for compact storage of the modular devices when not in use. Futhermore, the musician is permitted to use as many or as few modular devices as is necessary to cover the number of octaves or keys on a keyboard on which the music to be recorded is played. Fewer modules are needed if the music is played on only two or three octaves or if the music is played on a smaller keyboard instrument, such as an accordian or organ. To expand the invention to a larger keyboard instrument, such as an acoustic piano, the musician need only connect more keyboard modules as required. Preferably, the position of each module on the keyboard is uniquely identified by its digital code which the musician can label using a dip switch 24 or other module-identifying means contained on the module 10.

Figure 3A:
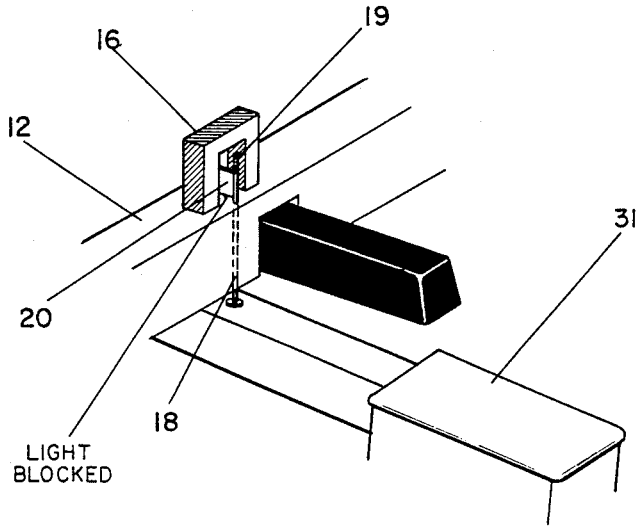
FIG. 3 is a perspective view of the preferred modular device of the invention, comprising a one octave module, a series of optical transmissive couplers, wiper and plunger assemblies, module circuitry, interconnecting pins, and a module cover.
Figure 3B:
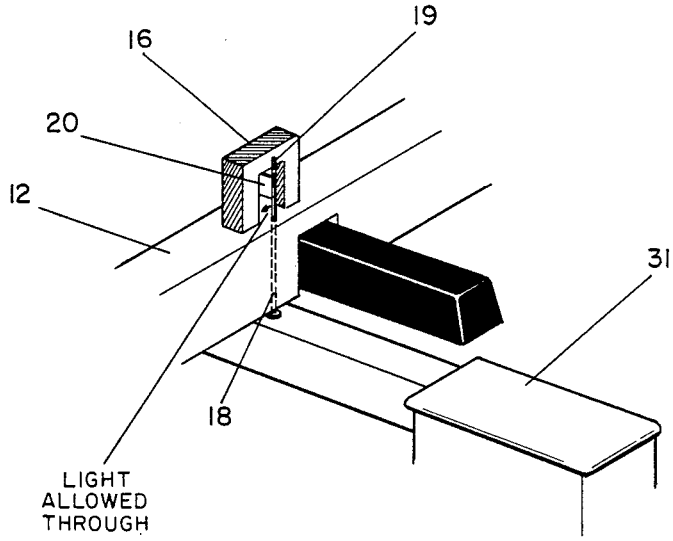

The modular device of the invention obtains musical data representing the keys struck on the keyboard through an optical transmissive coupler 16 (see FIGS. 3(*a*) and 3(*b*). The optical transmissive coupler 16, mounted in the keyboard mold 12, comprises a light emitting diode (LED) and a phototransistor. Optical transmissive couplers, common to the art, contain an LED and a phototransistor, and thus the LED and phototransistor are not separately shown in FIGS. 3(*a*) and 3(*b*). When light from the LED impinges on the phototransistor, an analog voltage proportional to the intensity and amount of light is produced. Referring now to the principle of analog operation, as a piano key 31 is pressed down (see FIG. 3(*a*)), a gravity operated piston 18 connected to a wiper assembly 20 correspondin9ly moves downward. This motion of the frictionless wiper assembly 20 interrupts the light signal and causes the voltage generated in the phototransistor to decrease.

Figure 4:
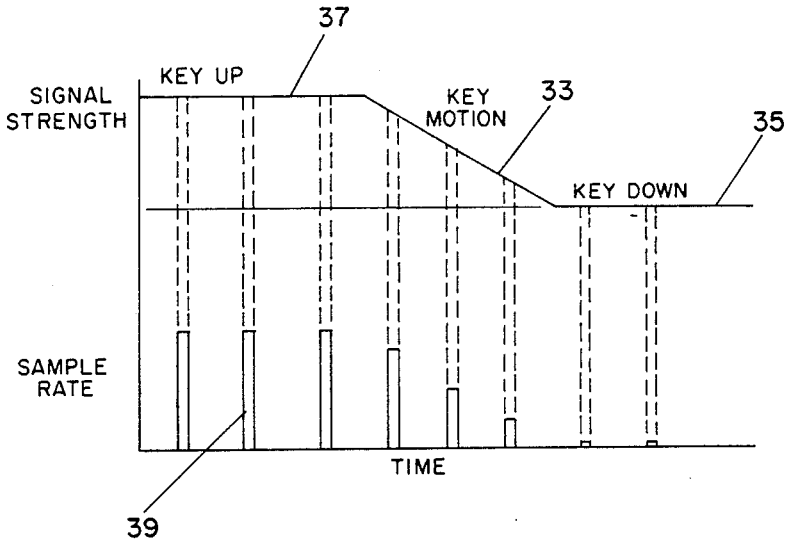
FIG. 4 is a timing diagram which shows the decrease in analog voltage signal strength as a function of time to calculate key attack velocity.

FIG. 4 is a graph of the voltage signal strength as a function of time, corresponding to the downward motion of a key. When the key is in an "up" or at rest position 37, the voltage signal strength is high. As the key is in downward motion 33, the voltage signal strength decreases. When the key is in a "down" position 35, the voltage signal strength is low. The clocked voltage sample pulses 39 indicating the sample rate are illustrated at the bottom of the graph.

Figure 5:
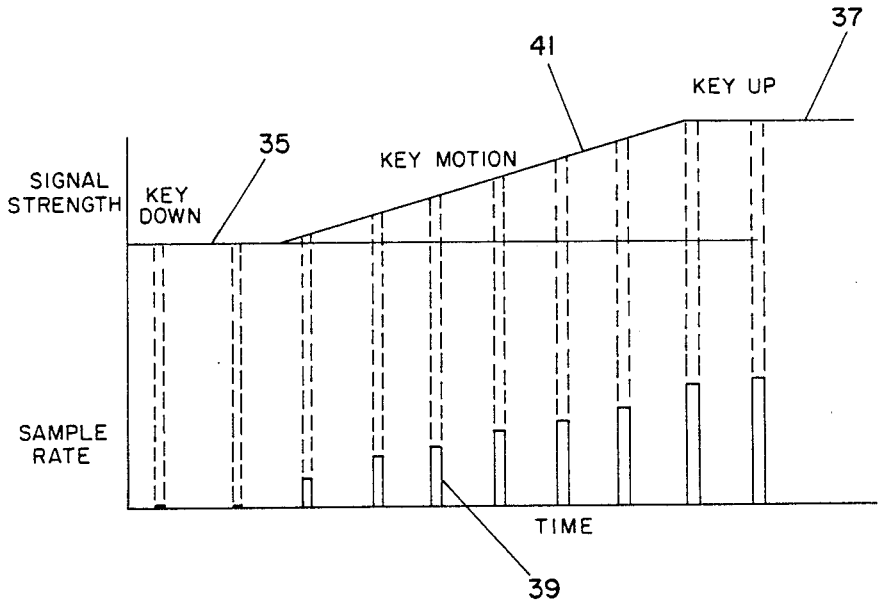
FIG. 5 is a timing diagram which shows the increase in analog voltage signal strength as a function of time to calculate key release velocity.

FIG. 5 is a graph of the voltage signal strength as a function of time, corresponding to the upward motion of a key. When the key is in a "down" position 35, the voltage signal strength is high. As the key 31 is released and returns to the up position 37 (see FIG. 3(*b*)), the wiper assembly 20 allows portions of light to impinge on the phototransistor, thereby increasing the voltage generated by the phototransistor. As the key is in upward motion 41, the voltage signal strength increases. When the key is in an "up" position 37, the voltage signal strength is low. The clocked voltage sample pulses 39 indicating the sample rate are illustrated at the bottom of the graph.

Preferably, each piston 18 is connected or attached to each wiper assembly 20 by adjustable connecting means to adjust for higher or lower keys depending on the particular keyboard. FIGS. 3(*a*) and 3(*b*) illustrate a preferred connecting means 19 comprising a threaded piston 18 and tapped wiper assembly 20 which can be adjusted to raise or lower the piston 18 to adjust to the height of the keys.

Figure 7:
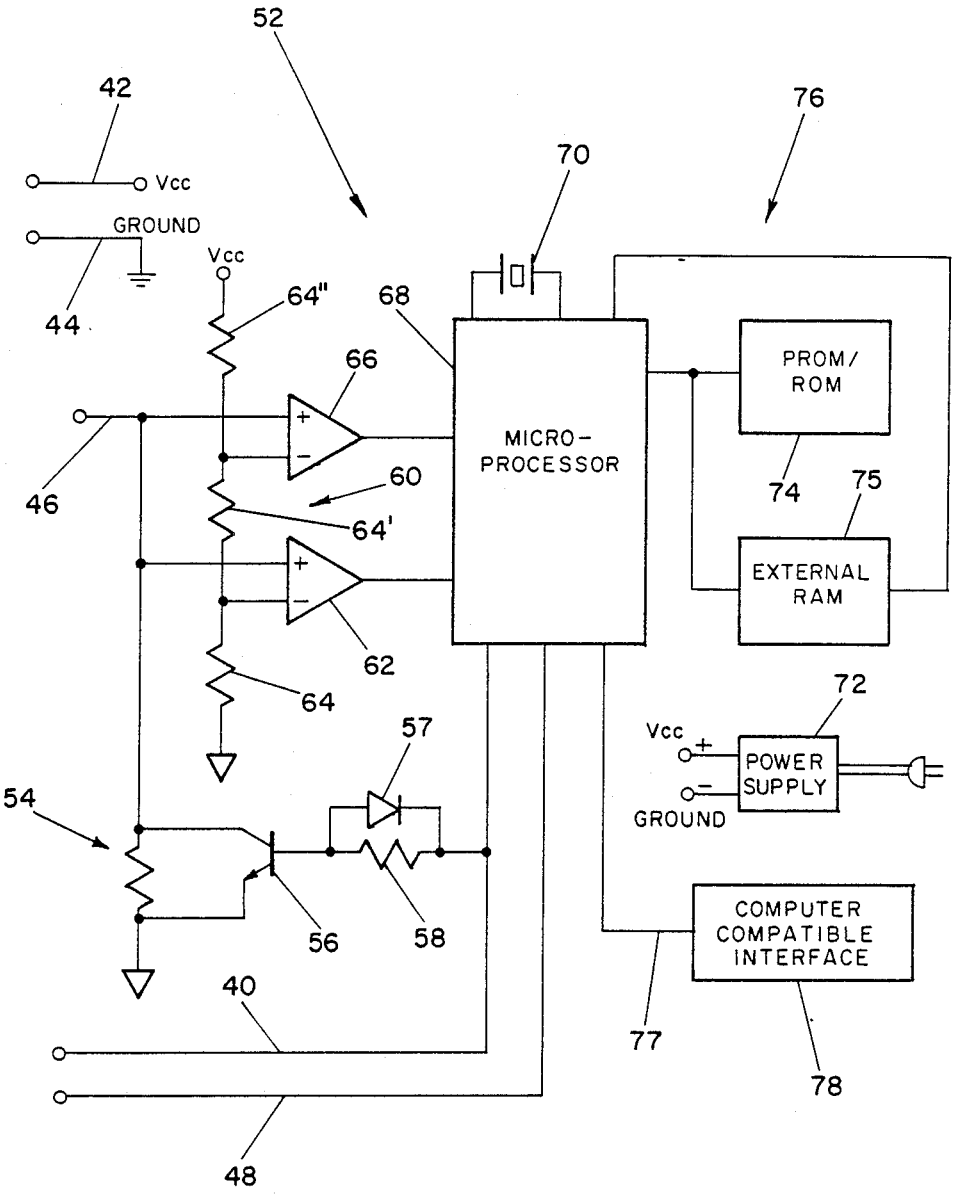
FIG. 7 is a diagram of the processing unit of the system of the invention and its relation to a computer-compatible link.

The attack and release velocity with which the key is played, is preferably determined by calibrating a low voltage level and a high voltage level in a comparator circuit 60 located off the keyboard module (See FIG. 7). Thus, important musical expression information, such as whether the note was played fortissimo, pianissimo, legato, or staccato, is captured.

Figure 6:
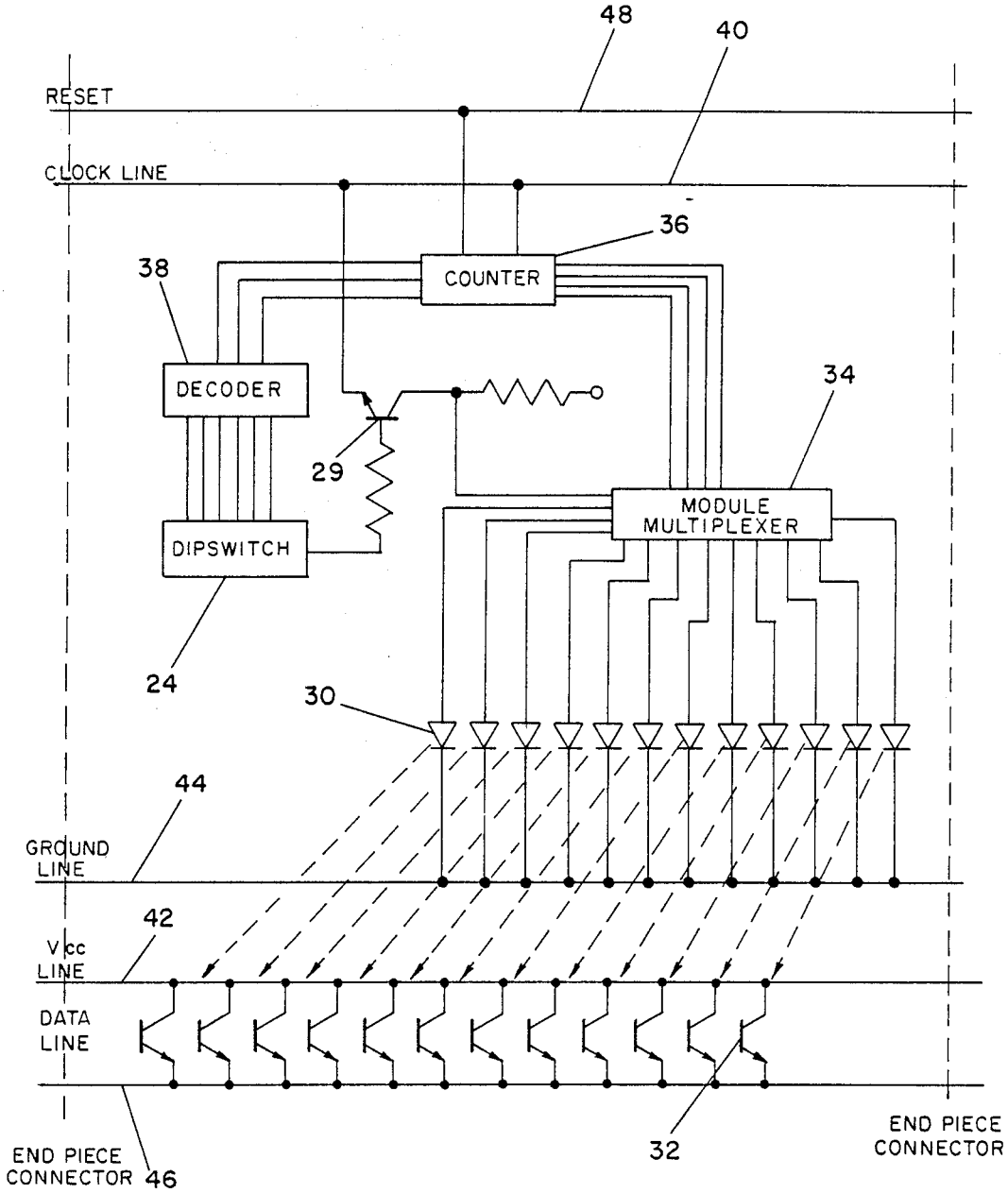
FIG. 6 is a schematic of an octave circuit board contained within a octave module of the invention.

FIG. 6 illustrates in more detail the preferred circuitry embodied in an octave modular device of the invention and the conducting lines running in and out of each module. The module circuitry enables each LED 30 corresponding to an individual key to emit light and permits the acquisition of voltage data. The keyboard modular device of the invention preferably comprises a module multiplexer 34, a binary counter 36, a decoder 38, module-identifying means such as a dip switch 24, light emitting diodes 30, phototransistors 32, and an enable circuit 29.

The binary counter 36 located on the modular keyboard device is advanced by negative-going clock pulses coming in on the clock pulse wire 40. The four least significant bits of the module binary counter 36 are sent to the keyboard module multiplexer 34 which sequentially turns on the corresponding LEDs 30 contained in the optical transmissive coupler. The LEDs 30 emit light (represented by the wavy lines in FIG. 6) which is detected by the phototransistors 32. This sequential enabling technique minimizes power requirements because at any one time only one LED 30 emits light to be detected by one phototransistor 32. On a next negative-going clock pulse, the module multiplexer 34 selects the next key within that keyboard module. If, however, all of the LEDs 30 in that particular module have been strobed, the binary counter 36 then reads the uppermost significant digits counted from the clock pulses and advances the scan to the next keyboard module (assuming more than one module is being utilized). The module multiplexer 34 on the next keyboard module device selects the first key in that module and turns on its corresponding LED 30. Thus, for example, after eighty-eight negative-going clock pulses occur, all the keys of a standard acoustic piano keyboard have been sampled. The microprocessor then generates a positive-going pulse. The positive-going clock pulse enters the enable circuit 29. The enable circuit 29 functions to clear the module multiplexer 34 and turn off all the LEDs 30 on that module just prior to the beginning of a data cycle beginning with the subsequent negative-going pulses. Thus, the enable circuit 29 operates as an open circuit to the data line 46 while the compensation circuit 54 (FIG. 7) shorts out any residual charge on the data line 46.

Preferably, each modular device contains a dip switch 24 or other module identifying means, connected to the on-board modul circuit. The musician labels each module by a series of unique binary digits coded in the dip switch 24. The binary counter 36 and decoder 38 (See FIG. 6) count the clock pulses coming into the module. When the uppermost significant digits within the binary counter 36 match the binary digits encoded in the dip switch 24 of the module, the LEDs 30 of the module are strobed during the negative-going cycle of clock pulse and the data collected. This preferred embodiment is particularly useful when the module is an octave module; each octave dip switch is uniquely set to identify its particular octave position. As an alternative embodiment, the module identifying means is preset and cannot be modified by a musician. The musician would use a particular module only in its intended position on a keyboard. For example, there could be a "middle-C" octave module and a "high-C" octave module; or for an organ, an "upper-keyboard" module and a "lower-keyboard" module.

Each modular device of the invention preferably contains five conducting lines or less. This feature of the device of the invention not only enhances the unique design and function of the invention, but also provides for the increased compactness of the modular keyboard device because it eliminates bulky parallel data input and output channels, which are common in the prior art. The first conductor 40 provides clock pulses to the binary counter 36 and the module multiplexer 34. The clock pulses are derived from, for example, a twelve MHz oscillating crystal 70 located on a processor unit, as shown in FIG. 7. The compact keyboard modular device of the invention embodies a single-clock/single-line multiplexing scheme. This single-line multiplexing configuration, however, does not preclude the use of several independently operating multiplexed lines to individual keyboard modules for faster data acquisition and processing. The preferred sequential sampling method described above simply minimizes line and mechanical termination numbers. A second conductor 42 provides the necessary voltage for the module circuit units, Vcc, while a third conductor 44 functions as ground. A fourth conductor 46 transmits analog voltage data from the phototransistors 32 to an off-board processor unit 52 (see FIG. 7). A fifth conductor 48 is not essential to the operation of the keyboard modular device of the invention, but is preferable to incorporate optional features, such as a reset line to the modular circuitry. FIG. 6 illustrates the preferred use of the fifth conductor 48 as a reset.

The data derived from the modular keyboard device of the invention comprises an analog voltage signal generated by the phototransistor 32 of each key which is proportional to the amount and intensity of light impinging upon the phototransistor 32 as its corresponding LED 30 is activated (see FIGS. 3(*a*)). The analog voltage data is then serially transmitted from the keyboard module via the data-out conductor 46 to be analyzed and converted in the processing unit of the invention (See FIG. 7).

FIG. 7 is a diagram of the processing unit 52 of the system of the invention which preferably comprises a compensation circuit 54, a comparator circuit 60, a microprocessor 68, clocking means such as an oscillating crystal 70, a power supply 72, a PROM/ROM 74 which may be internal or external to the microprocessor 68 and an external RAM 75 (Random Access Memory). FIG. 7 also illustrates five conducting lines, described earlier and in FIG. 6: the clock line 40; the Vcc line 42; the ground line 44; the data line 46; and the optional line 48. FIG. 7 further illustrates the data transmit link 77 to the computer-compatible interface 78.

When a PROM/ROM such as a type 2716 made by Intel Corporation, Santa Clara, Calif. and/or a RAM are external to the microprocessor, the combined microprocessor and the external memory are referred to as a microcomputer. FIG. 7 illustrates the embodiment of a microcomputer 76 in the system of the invention. Alternatively, a PROM/ROM and a RAM internal to a microprocessor may also be utilized in the system of the invention. One microprocessor which is useful in the system of the invention is a type 8031 integrated circuit made by Intel Corporation.

The clocking means 70, of the system of the invention, such as a twelve MHz oscillating crystal, is of an appropriate frequency corresponding to the requirements of the microcomputer 76. The system of the invention could use a crystal oscillating at a higher frequency if the microprocessor selected will accommodate the faster speeds. A power supply 72 is of a sufficient voltage to provide power to the integrated circuits on the keyboard modular device and the processing unit 52. An alternative embodiment of the invention utilizes optional battery capability thereby replacing the power supply.

The compensation circuit 54 of the system of the invention comprises a compensating transistor 56, a diode 57 and a resistor 58. The compensation circuit 54 accommodates rapid sampling times by discharging any residual voltages on the phototransistors 32 (see FIG. 6). Phototransistors 32 have a significant time delay in returning to an off state because the charge contained in the phototransistors 32 depletes relatively slowly. To increase the response time of the phototransistors 32 and to eliminate the possibility of erroneous voltage readings, it is necessary to rapidly discharge any residual voltages remaining on the phototransistors 32 before the next cycle. Each strobe and data acquisition cycle comprises a number of negative-going clock pulses, for example, eighty-eight negative-going clock pulses for a standard acoustic piano keyboard, followed by a positive-going clock pulse. The positive-going clock pulse, generated by the microprocessor 68, enters the compensation circuit 54. This positive-going pulse causes the compensating transistor 56 to ground residual voltages remaining on the phototransistors 32. The cycle of sequentially enabling the LEDs 30 is then repeated starting on the following negative-going clock pulse from the clocking means 70. Thus, the compensation circuit 54 ensures that the phototransistors 32 have no residual voltages and are clean for the next cycle of the system.

In the system of the invention, the analog voltage data from the phototransistors 32 enters the comparator circuit 60 on the data out conductor 46. The comparator circuit 60 preferably comprises a differential comparator 62 which is calibrated by the use of resistors 64, 64' and 64'' to detect a low voltage level generated by the phototransistors 32. A low voltage level is typically ten percent of Vcc. A second differential comparator 66 is calibrated by the use of resistors 64, 64' and 64'' to detect the high voltage level, which is typically ninety percent of Vcc. An alternative embodiment of the system of the invention is the replacement of the comparator circuit with an analog-digital converter (A/D), common to the art. In such an alternative embodiment, analog voltage levels derived from the phototransistors are digitized for entry to a microcomputer.

The comparator circuit 60 functions as follows (see FIGS. 3(*a*)–7). When a key 31 of a keyboard instrument is in an upright position 37 and is not being played, light emitted from the LED 30 is not blocked and the voltage subsequently generated by the phototransistor 32 is greater than the high voltage level, and, of course, greater than the low voltage level. Thus, the output of the low voltage comparator 62 and the output of the high voltage comparator 66 are both high or logical one. The microcomputer 76 then determines that the key 31 has not been played. The same principle, in reverse, applies when the key 31 is pressed all the way down 35 and the li9ht emitted from the LED 30 is blocked. In this case, the voltage generated by the phototransistor 32 is less than both the high and the low voltage levels calibrated in the comparator circuit 60 and the outputs of the comparators 62 and 66 are both low or logical zero. The microcomputer 76 then determines that the key 31 is in the down position 35. A more interesting case arises when the key 31 is in transition 33 and 41. In this case, the analog voltage from the phototransistor 32 is less than the high voltage level, but is still greater than the low voltage level. Thus, the signal from the low voltage comparator 62 is high or logical one, but the signal from the high voltage comparator 66 is low or logical zero. The microcomputer 76 again registers this transition and proceeds to further process the information to calculate key attack or key release velocity.

Figure 8:
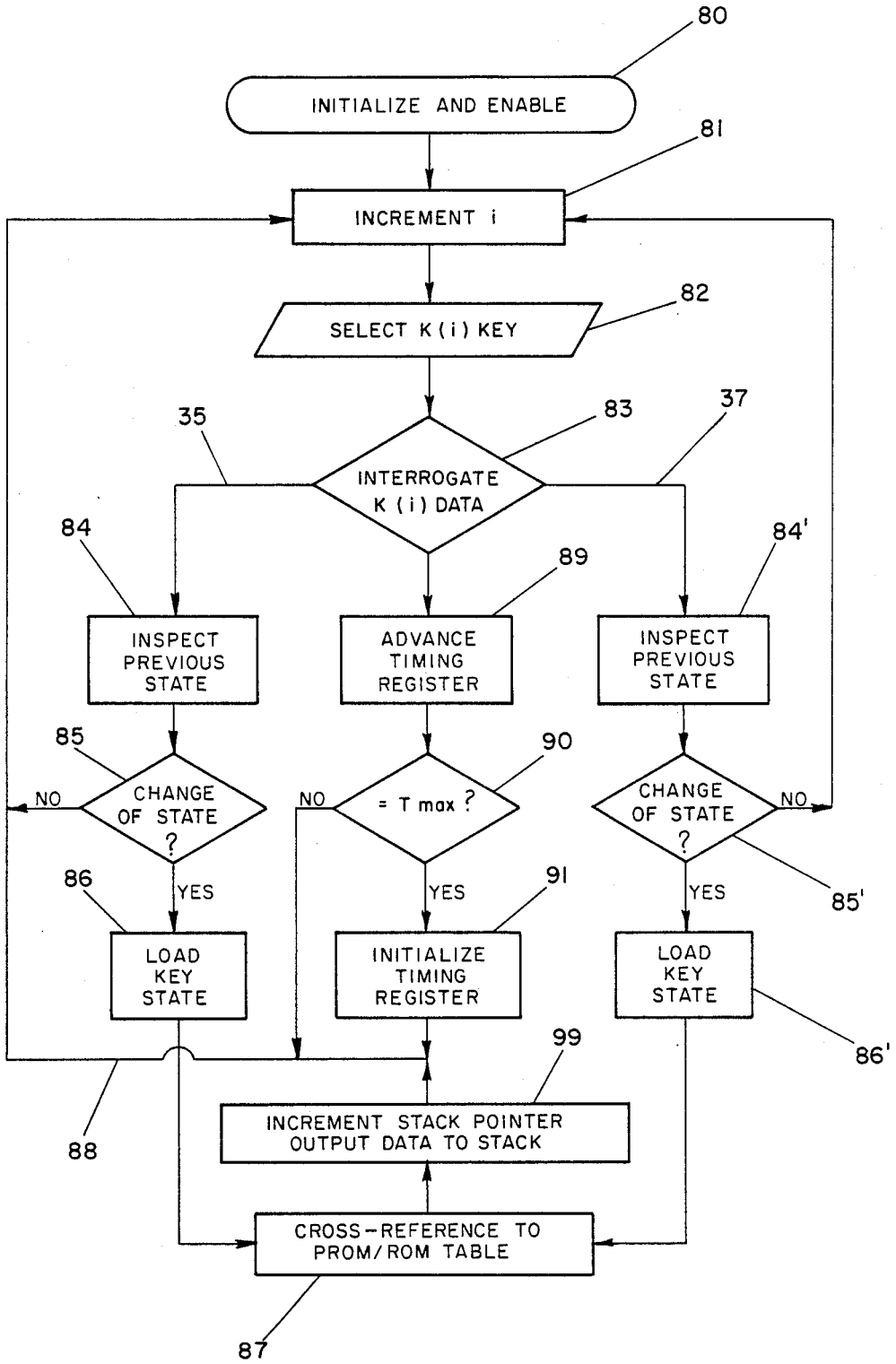
FIG. 8 is a flowchart representing the instructions executed by the main program of the microcomputer of the invention.
Figure 9:
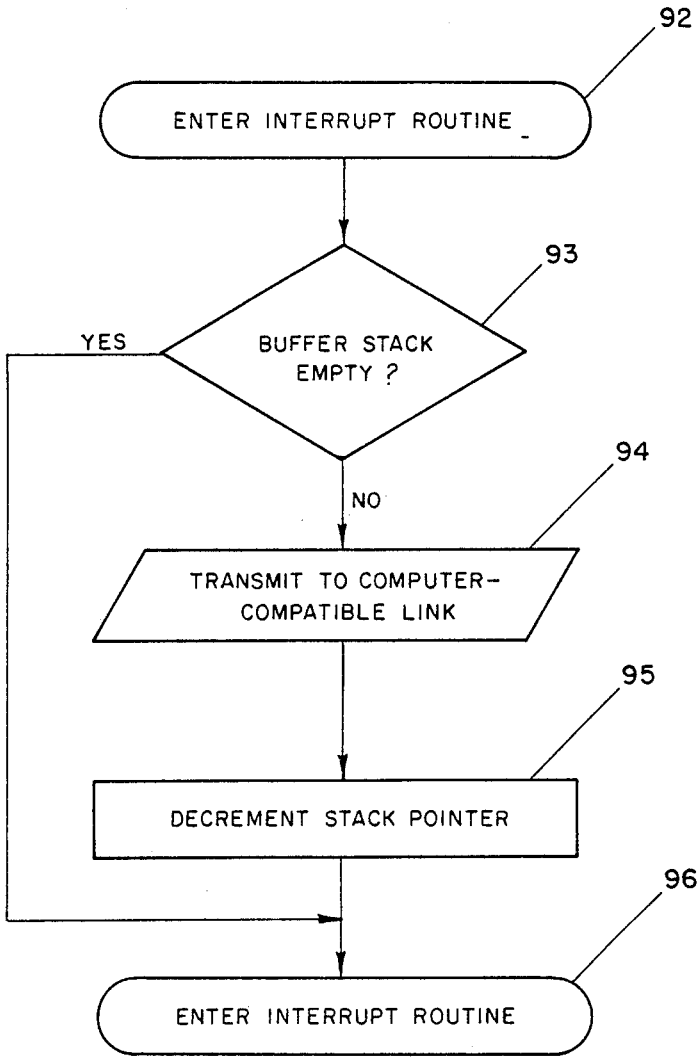
FIG. 9 is a flowchart representing the instructions executed by the interrupt routine of the microcomputer of the invention.

The flowcharts of FIGS. 8 and 9 (also see FIGS. 3(*a*)–7) shows preferred operation and decision boxes representative of processes run by the microcomputer 76 to extract note and note expression data from the output of the comparator circuit 60. The microcomputer 76 further converts that data to a computer-compatible bus and protocol specification, such as the MIDI specification, described in Keyboard Synthesizer Library, Vol. 3, *Synthesizers and Computers,* pp. 114–126 (1985).

Processing and converting the data from one key occurs within one cycle time. The cycle time is fast enough to detect key velocity ranges typical of musical performances up to approximately five miles per hour (eighty-eight inches per second. To determine key attack and release velocities within this velocity range, the cycle time ranges from between approximately twenty microseconds and fifty microseconds. This cycle time range is more than sufficient to resolve music played in one-sixty-fourth notes (or even faster notes). Thus, the invention is capable of accurately acquiring and processing note and note expression data for any music played.

Data processing as shown in FIG. 8 begins with a command 80 to initialize the keyboard modular device of the invention and the microcomputer 76. A generated positive-going pulse on the reset line 48 initializes the keyboard modular device by clearing the binary counter 36, while a positive level on the clock line 40 shorts out any residual charge on the phototransistors 32 via the compensation circuit 54, and prepares the LEDs 30 for strobing via the enable circuit 29. Internal program registers, counters and pointers of the microcomputer 76 are also initialized. The computer-compatible communication link 78 generates an interrupt signal and requests any preliminary data exchange transmission requirements. In this fashion, the system of the invention is initialized and is prepared for data acquisition, processing and transmission.

An index "i" identifies the particular key which is being strobed and sampled. The index i is incremented 81 from K(i)=0 up to the number of keys covered by the modular devices of the invention; for example, on a standard acoustic eighty-eight key piano, K(i), i=0.87. The maximum value of the index i would be increased for other signal inputs to the system, such as signals carrying sustain pedal information.

The microprocessor 68 selects 82 the output from the comparator circuit 60 containing the key and key expression data of the K(i) key. The two outputs of the comparator circuit are interrogated 83. Depending upon whether the logical states of the comparator outputs are equal or are not equal, the program instructions branch to different functions.

The data output of the two comparators 62 and 66 may be equal, i.e., both data bits are high or logical one or both data bits are low or logical zero; indicating that the key is in the up position 37 or the down position 35, respectively. In either of these situations, the state of the K(i) key for the previous keyboard cycle is inspected 84 and 84'. The state of the K(i) key is compared 85 with the state of the same key on the previous strobe. If the current state of the key, K(i), remains unchanged from the previous state, the program returns 88 to the beginning of the loop, increments 81 the index to i=i+1 and selects 82 the comparator data output corresponding to the K(i+1) key. The processing cycle is repeated in the above fashion. If, however, the current state of key K(i) has changed from the previous state of key K(i), then the microprocessor 68 loads 86 the data representing the current state of the key into a temporary memory location. The key and key expression data of the prior state of the key is cross-referenced 87 to a table located in PROM/ROM 74 to obtain the suitable format of note and note expression data for transmission to the computer ports 78. The program then returns 88 to the beginning of the loop, increments 81 the key index, and processes the data from the next key, as described earlier.

On the other hand, when the key K(i) is in transition 33 and 41, the outputs of the two comparators 62 and 66 are not equal, i.e., one data bit from a comparator is high or logical one and the other data bit from the other comparator is low or logical zero. The microprocessor 68 advances 89 a timing register to measure elapsed time while the key is in transition. This timing register is used to calculate key attack or release velocity depending upon the direction of the transition. Attack and release velocities are defined as a normalized register count which is cross-referenced 87 to an address in an internal PROM/ROM 74 table. The value stored in the PROM/ROM 74 table corresponds to a velocity for a particular count. The velocity, converted to an appropriate protocol, can then be transmitted to the computercompatible link 78.

The timing register counts only to a predefined maximum count, $T_{max}$. This $T_{max}$ limit operates as a fault to prevent the timing register from counting indefinitely in the event a key is stuck in a transitional position. In this situation, the timing register is advanced 89 and when the timing register becomes equal 90 to $T_{max}$, the register is initialized 91.

Data transmission to the computer-compatible link 78, preferably a MIDI, is performed on an interrupt basis (see FIG. 9). The note and note expression data, converted to the proper format for transmission in the main program, is immediately sent to a transmit buffer stack, the stack pointer is incremented 99 and control is diverted to an interrupt routine. The contents of the buffer stack are inspected 93. If the buffer stack is empty, control is returned 96 to the main program at which it was interrupted. The buffer stack is not empty when there is note and note expression data awaiting transmission. The interrupt routine will then transmit 94 note and note expression data to the computer-compatible link 78 and decrement 95 the transmit buffer stack pointer. The transmission and communication hardware in the computer-compatible link 78 generate a "transmission complete" signal and sends an interrupt signal control to the main program when the serial data transmission is completed. If, however, untransmitted note and note expression data is present on the transmit buffer stack when the "transmission complete" signal is generated, the interrupt signal interrupts the main program, and the next note and note expression data is transmitted 94. With each data transmission, the transmit buffer stack pointer is decremented 95. When the buffer stack is empty, the interrupt routine returns control to the main program 96. Commercially available software, common to the art, then manipulates the note and note expression data to musical scores or other acceptable formats to be viewed on a computer screen 97 or to be printed in scored form on a printer 98.

Accordingly, an invention has been discovered to simultaneously capture, analyze and record live keyboard musical performances. The device and system of the invention are easy to install and operate and are less expensive and easier to use than prior art music recording systems.

I claim:

1. A portable, modular appartus for acquiring data representative of a live musical performance on a selected keyboard instrument, said apparatus being removably positionable atop a back portion of the keyboard of the instrument, said apparatus comprising:

a housing designed with slots to fit atop a predetermined span of black and white keys on the keyboard of the selected keyboard instrument, said housing being structured for disposition atop the back portion of the keyboard and to operatively cover the predetermined span of keys on the keyboard;

means for providing, without modification to the keyboard, as a function of time, electrical analog output signals representative of amount of depression for each of the keys operatively covered by said housing on the keyboard; and means for monitoring the electrical analog output signals of each key to acquire data representative of the live musical performance.

2. The apparatus of claim 1 wherein said electrical analog output signal providing means comprises light emitting means, and, for each key on the keyboard covered by said predetermined span, means for modulating light from said light emitting means in accordance with the amount said key is depressed, and means for receiving the modulated light and for producing an electrical analog output signal corresponding to the amount the light is modulated for said key.

3. The apparatus of claim 1 wherein said electrical analog output signal monitoring means comprises means for enabling each said analog output signal providing means at preselected time intervals.

4. The apparatus of claim 3 wherein said electrical analog output signal monitoring means comprises means for ebabling said electrical analog output signal providing means in a preselected sequence.

5. The apparatus of claim 4 wherein said monitoring means comprises means for clocking said electrical analog output signal providing means to acquire data representative of key strike and release velocity.

6. The apparatus of claim 5 wherein said electrical analog output signal blocking means comprises means for clocking said electrical analog output signal sufficiently fast to provide data accurately representative of key strike and release velocities.

7. The apparatus of claim 5 wherein said monitoring means comprises means for comparing consecutive electrical analog output signals from a key's electrical analog output signal providing means to determine if the amount of key depression has changed and means for generating note expression data representative of key strike and release velocity for such key in response to changes in consecutive electrical analog output signals from its associated electrical analog output signal providing means.

8. The apparatus of claim 5 further comprising means for converting said data representative of the live musical performance to a form transferable to a computer compatible link.

9. The apparatus of claim 1 wherein said light modulating means comprises, for each covered key, means for blocking light from said light emitting means in accordance with amount of key impression.

10. The apparatus of claim 9 wherein said light emitting means comprises a light emitting diode for each covered key.

11. The apparatus of claim 9 wherein said electrical analog output signal providing means comprises, for each covered key, a phototransistor.

12. The apparatus of claim 11 wherein said light blocking means comprising, for each covered key, a wiper.

13. The apparatus of claim 1 further comprising means for operatively connecting at least two of said modular apparatuses.

14. The apparatus of claim 13 wherein each said modular apparatus comprises an encodable module identifying means.

15. The apparatus of claim 13 wherein each said modular apparatus is an octave module comprising a housing operatively covering twelve keys.

* * * * *